US008181569B1

(12) United States Patent
Lewandowski

(10) Patent No.: US 8,181,569 B1
(45) Date of Patent: May 22, 2012

(54) LOOSE MATERIAL AND GARDEN DEBRIS LIFTING AND COMPACTING DEVICE AND METHOD OF USE

(76) Inventor: Kenneth Anthony Lewandowski, Milton, MA (US)

( * ) Notice: Subject to any disclaimer, the term of this patent is extended or adjusted under 35 U.S.C. 154(b) by 275 days.

(21) Appl. No.: 12/752,120

(22) Filed: Apr. 1, 2010

Related U.S. Application Data

(60) Provisional application No. 61/165,009, filed on Mar. 31, 2009.

(51) Int. Cl.
*B30B 13/00* (2006.01)
*B30B 15/06* (2006.01)

(52) U.S. Cl. ..... 100/35; 100/265; 100/295; 100/211; 100/102; 294/156

(58) Field of Classification Search ..... 100/35, 100/36, 87, 211, 212, 226, 227, 228, 265, 100/295, 299, 102; 53/461, 464; 56/329, 56/400.1, 400.12; 15/257.1; 294/152, 156
See application file for complete search history.

(56) References Cited

U.S. PATENT DOCUMENTS

| | | | | |
|---|---|---|---|---|
| 2,564,907 | A * | 8/1951 | Krummel, Jr. | 56/400.1 |
| 4,434,829 | A * | 3/1984 | Barnard | 383/34 |
| 4,519,183 | A * | 5/1985 | Parody | 53/461 |
| 4,682,539 | A * | 7/1987 | Bramblett et al. | 100/265 |
| 4,693,504 | A * | 9/1987 | Baker | 294/219 |
| 6,415,713 | B1 * | 7/2002 | Abrams | 100/246 |
| 7,152,894 | B2 * | 12/2006 | Weathers et al. | 100/295 |
| 2004/0212201 | A1 * | 10/2004 | Esposito | 294/1.1 |

* cited by examiner

*Primary Examiner* — Jimmy T Nguyen
(74) *Attorney, Agent, or Firm* — Jodi-Ann McLane

(57) ABSTRACT

A debris removal and compacting tool includes a lifting device having a flexible sheet with a first edge secured to a first support member, a second edge secured to a second support member, and a compaction device including a first surface attachable to the lifting device and a second surface for contacting the loose material within the receptacle. A fastening mechanism is provided to removably secure the lifting device to the compaction device. During use, a user engages the first and second support members and places the sheet into contact with the material, utilizes the support members to move the sheet to consolidated and maneuver the loose material. The lifting device is placed within the interior of the receptacle, and the material is released into the receptacle. The compacting device is then placed into contact with the material to compact it within the receptacle to achieve better receptacle utilization.

19 Claims, 7 Drawing Sheets

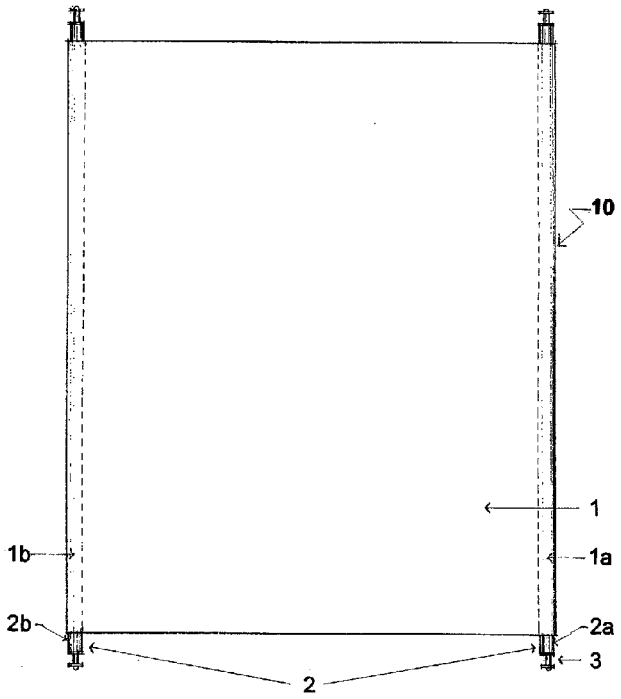
Figure 1 Top View
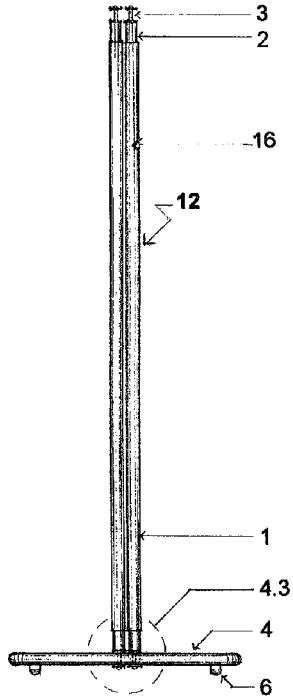
Side View Figure 3
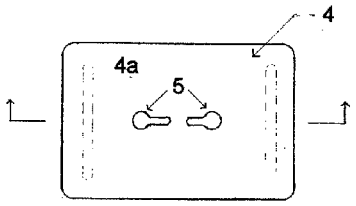
Figure 2 .1 Top View
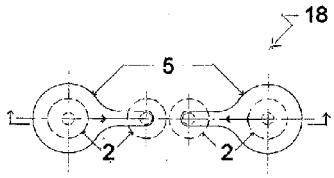
Plan Detail Figure 4.1
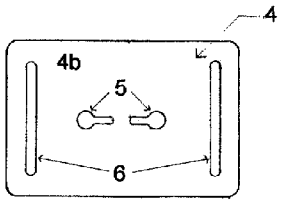
Figure 2.2 Bottom View
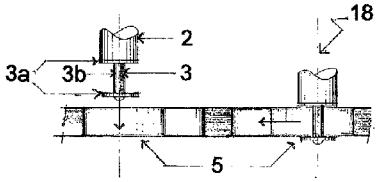
Section Detail Figure 4.2
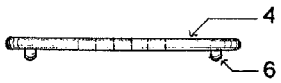
Figure 2.3 Side View
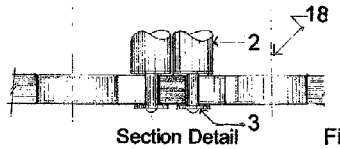
Section Detail Figure 4.3

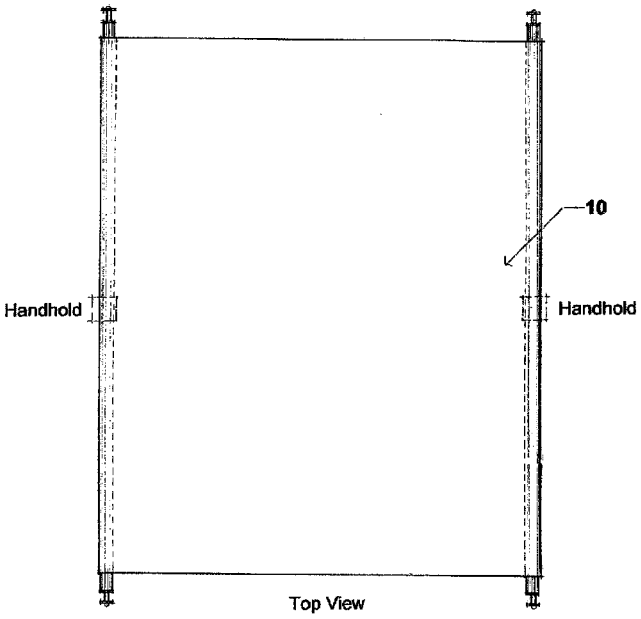
Figure 5.1
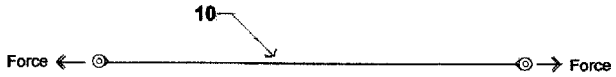
Figure 5.2 Side View
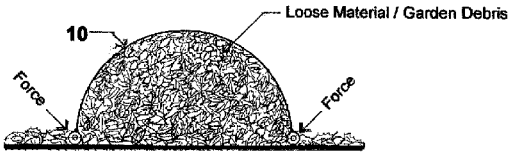
Figure 6 Side View
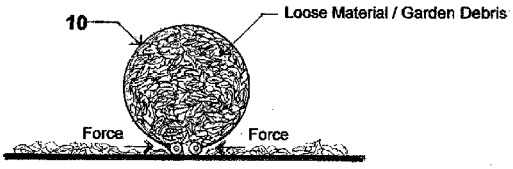
Figure 7 Side View
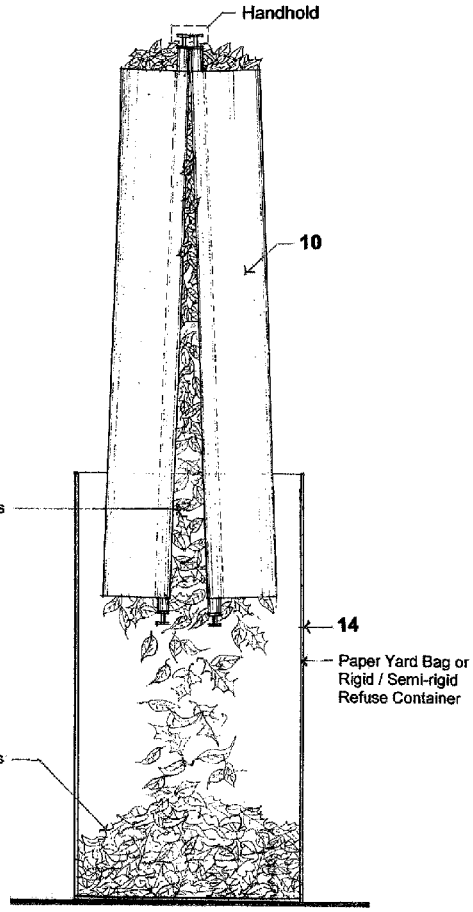
Figure 8

Front View

Side View

LOOSE MATERIAL AND GARDEN DEBRIS LIFTING AND COMPACTING DEVICE AND METHOD OF USE

CROSS-REFERENCE TO RELATED APPLICATIONS

This application claims the benefit of priority of U.S. Provisional Patent Application No. 61/165,009, filed Mar. 31, 2009 and entitled "Loose Material/Garden Debris Lifting and Compacting Device", the entire contents of the application being incorporated herein by reference in its entirety.

TECHNICAL FIELD

This invention relates generally to a device for lifting and removing loose, solid material and garden debris and, more specifically, to a debris removal and compacting tool for consolidating, lifting, and maneuvering the debris to a suitable refuse receptacle and compacting the debris within the receptacle.

BACKGROUND

The use of rakes and brooms is known for consolidating loose material such as leaves, plant clippings and other debris into large piles. Thereafter, the materials may be transferred to a refuse receptacle by hand, shovel or other device. Typically, the transfer capacity of such devices is limited to a small amount due to the relatively lightweight of the material which makes it difficult to control, and the fact that the devices are not specifically designed to handle this type of material. Further, once the material is in the receptacle, the material's light weight results in a great deal of under-utilized air space and therefore results in inefficient receptacle utilization.

In an attempt to facilitate the collection and transfer of loose, solid material and garden debris, collection and transfer devices have been developed in the prior art. In addition, there are also separate prior art devices for the compaction of loose solid material and garden debris. For example, U.S. Pat. Nos. 2,564,907 and 4,693,504 both disclose devices for picking up lawn, garden and other loose debris; while U.S. Pat. Nos. 4,158,995 and 7,152,894 disclose devices for packing waste materials and debris into garbage bags or containers with the device of the '894 patent being attachable to the end of a rake. Although these patented devices provide some help to the worker, this type of yard and/or gardening work remains time consuming and inefficient.

SUMMARY

In accordance with the present disclosure, there is provided a debris removal and compacting tool for consolidating, lifting and compacting loose material within a receptacle. The debris removal and compacting tool includes a lifting device having a flexible sheet with a first edge and a second edge, the first edge being secured to the first support member and the second edge being secured to the second support member. The flexible sheet being disposed there between and a compaction device including a first, top attachable to the lifting device, and a second, bottom surface opposite the top surface to contact the loose material within the receptacle in order to compact the same.

A fastening mechanism is also provided to removably secure the lifting device to the compaction device. During use, a user engages the first and second support members to place the flexible sheet into contact with the loose material, and utilizes the first and second support members to move the flexible sheet in order to consolidated and maneuver the loose material onto the flexible sheet. The user then lifts the lifting device, placing it within the interior of the receptacle, and releases the loose material from within the lifting device into the receptacle. Thereafter, the user attaches the compaction device to the lifting device, places the compacting device into contact with the loose material and applies a force in order to compact the material within the receptacle to achieve better receptacle utilization.

The present invention improves the efficiency of consolidating loose solid material or garden debris such as leaves, plant clippings, initially collected in a pile on the ground or other surface; aids in maneuvering a substantial quantity of the collected material to the interior of a suitable refuse receptacle (e.g., standard paper yard bag, rigid or semi-rigid container), and can be utilized to compact the material within the receptacle to achieve better receptacle utilization.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

FIG. 1 is a top view of a lifting device of a debris removal and compacting tool in accordance with one embodiment;

FIG. 2.1 is a top view of a compaction plate of the debris removal and compacting tool in accordance with one embodiment;

FIG. 2.2 is a bottom view of the compaction plate of FIG. 2.1;

FIG. 2.3 is a side view of the compaction plate of FIG. 2.1;

FIG. 3 is a side view of the lifting device of FIG. 1 connected to the compaction plate of FIGS. 2.1-2.3, forming the debris removal and compacting tool in accordance with one embodiment;

FIG. 4.1 is a schematic view of a connection mechanism for connecting the lifting device of FIG. 1 to the compaction plate of FIG. 2.1;

FIG. 4.2 is a side cross-sectional view of the connection mechanism of FIG. 4.1 in a first position;

FIG. 4.3 is a side cross-sectional view of the connection mechanism of FIG. 4.1 in a second position;

FIG. 5.1 is a top view of the lifting device of FIG. 1 illustrating a handhold position during use;

FIG. 5.2 is a side view of the lifting device of FIG. 1;

FIG. 6 is a side view of the lifting device of FIG. 1 placed over a large pile of loose, solid material (e.g., leaves and garden debris);

FIG. 7 is a side view of the lifting device of FIG. 6 wrapped around the loose, solid material, the lifting device forming a generally cylindrical shape;

FIG. 8 is a side view of the lifting device of FIG. 6 positioned within a refuse receptacle and the loose, solid material being discharge by gravity into the receptacle;

DETAILED DESCRIPTION

The embodiments disclosed herein relate to a debris removal and compacting tool 12, that is a "two-in-one product" having two distinct devices that serve separate, but complimentary functions. The first device is a lifting device 10 designed to consolidate, maneuver and transport loose, solid material and garden debris (e.g., leaves, vegetation clippings, loose debris, etc.), initially collected in a pile on a ground or other surface into a receptacle, and the second device is a compaction device 4 designed to compress the loose, solid material within a receptacle in order to better utilize the space defined by the receptacle. After transporting the material the lifting device 10 can be used to discharge the material that has been collected into a suitable receptacle (e.g., standard paper yard bag or other container for holding debris). The compacting device 4 is then attached to the lifting device to form the debris removal and compacting tool 12 that can be used to compact the material within the receptacle by engaging the compacting device 4 with the loose, solid material.

Referring now to FIGS. 1 and 6, the first device, lifting device 10 includes a flexible sheet 1 that may be made from any of a variety of commercially available materials for example, cloth, plastic, vinyl, composite, and the like. The flexible sheet 1 defines a first sheet edge 1*a* and a second sheet edge 1*b*, positioned opposite and substantially parallel to the first sheet edge. A first support member 2*a* that can also be made from a variety of commercially available materials, for example wood, plastic, vinyl, metal, composite, etc., is disposed along the first sheet edge 1*a*, the first support member 2*a* being configured to maintain the first sheet edge in a substantially rigid position, for example by securing with a fastener such as staples, tacks, adhesive, and the like. Likewise, a second support member 2*b*, which can be made from the same or similar materials as the first support member, is disposed along the second sheet edge 1*b*. The second support member 2*b* is also configured to similarly maintain the second sheet edge 1*b* in a substantially rigid position.

Figure 11:
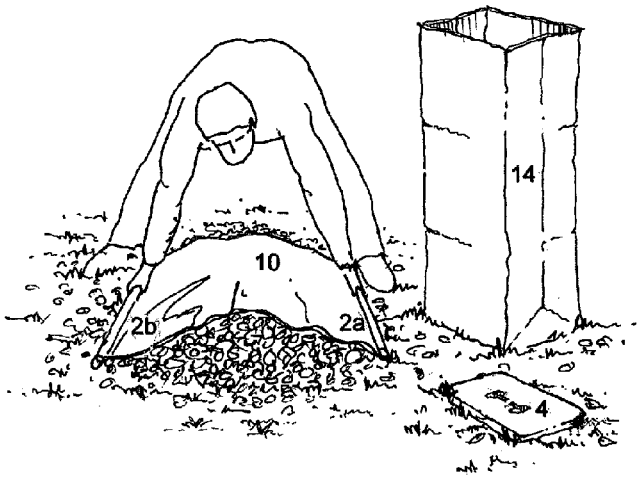
FIG. 11 is a perspective view of the lifting device of FIG. 6 illustrating a user holding the lifting device and placing the lifting device over a large pile of loose, solid material.
Figure 12:
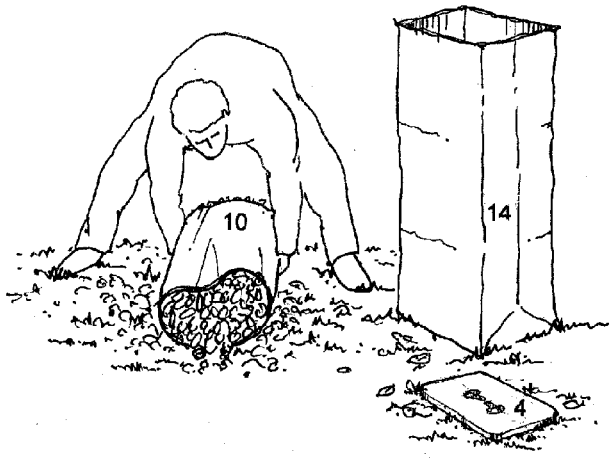
FIG. 12 is a perspective view of the lifting device of FIG. 6 illustrating a user holding the lifting device and consolidating the loose solid material by forming the lifting device into a cylindrical shape around the loose, solid materials in order to lift and transport the materials to a refuse receptacle.
Figure 13:
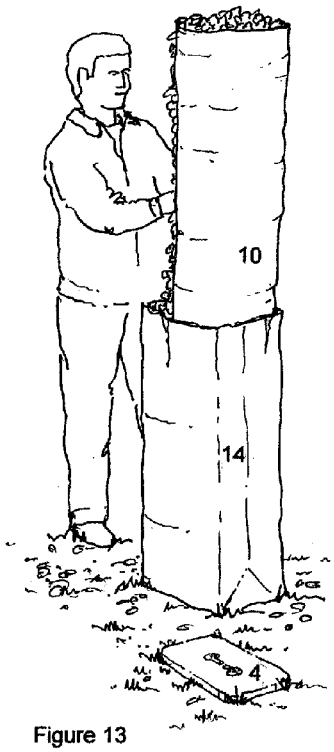
FIG. 13 is a perspective view of the lifting device of FIG. 6 illustrating a user positioning the lifting device within an exemplary receptacle (e.g., standard paper yard bag or other rigid/semi-rigid refuse container) to begin the discharge process of the loose, solid material.
Figure 14:
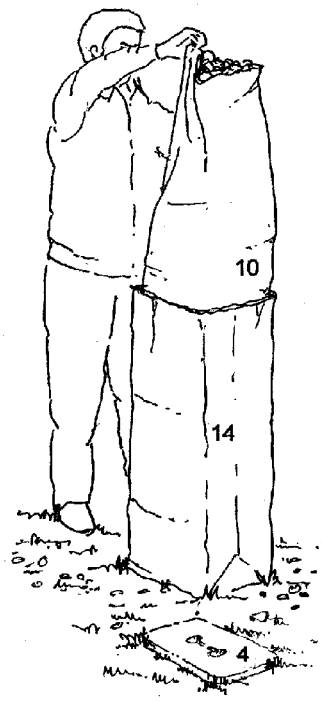
FIG. 14 is a perspective view of the lifting device of FIG. 6 illustrating a user with one hand securing a handhold, and the other hand helping to guide the loose material as it falls by gravity into the receptacle.
Figure 15:
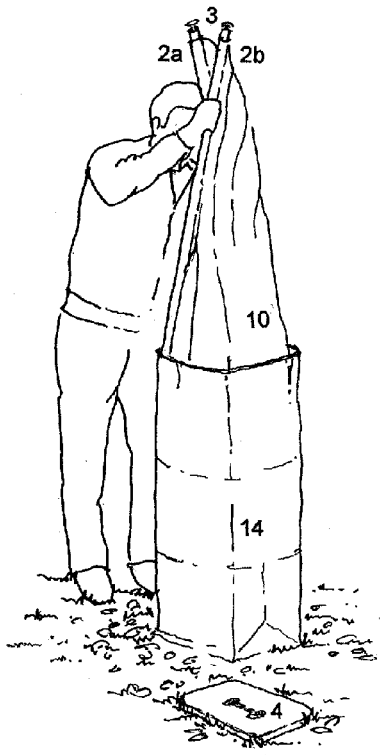
FIG. 15 is a perspective view of the lifting device of FIG. 6 illustrating a user emptying and removing the lifting device from the receptacle with one hand.
Figure 16:
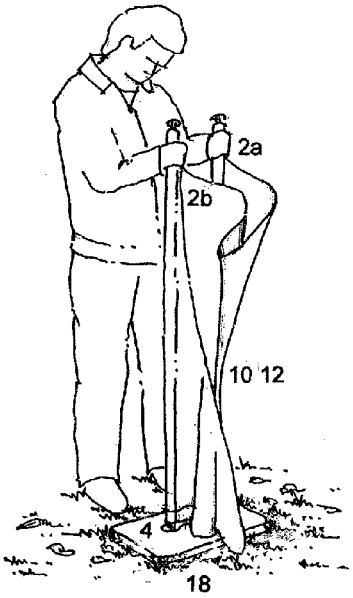
FIG. 16 is a perspective view of a user connecting the lifting device of FIG. 6 to the compaction plate of FIGS. 2.1-2.3 in order to form the multi-purpose tool of FIG. 3.
Figure 17:
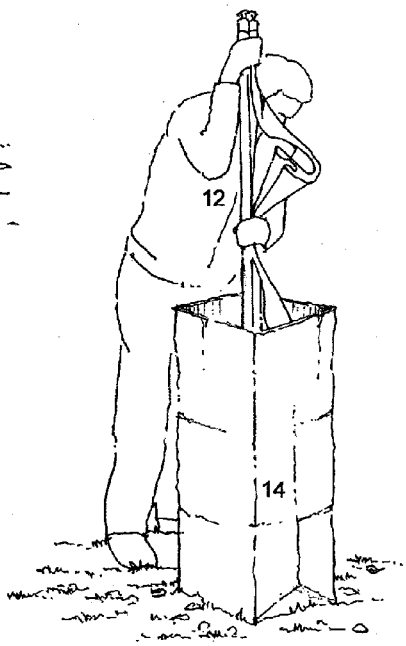
FIG. 17 is a perspective view of the debris removal and compacting tool of FIG. 16 in a first, ready position to begin the compression of loose material within the receptacle.
Figure 18:
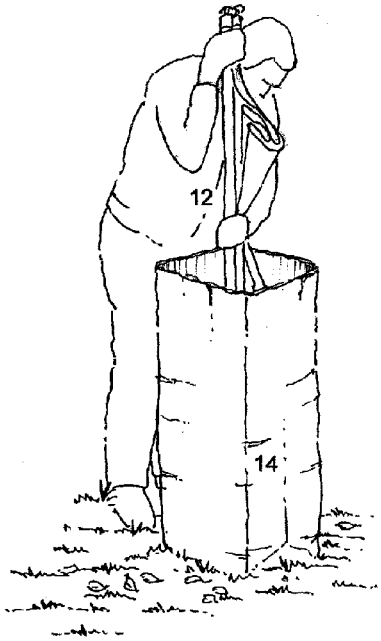
FIG. 18 is a perspective view the debris removal and compacting tool of FIG. 16 in a second, position illustrating a user applying a downward force to compress the loose material within the receptacle.

The support members 2*a*, 2*b* when joined together and attached to the compacting device 4 form handle 16 of the debris removal and compacting tool 12, as described in greater detail below. The support members 2*a*, 2*b* together with the flexible sheet 1 enable a user to place the flexible sheet over the loose, solid material and garden debris "D" and thereafter maneuver the flexible sheet with respect to the materials, as shown in FIG. 5, and to form the flexible sheet into a cylindrical shape (FIGS. 6 and 7) in order to contain the debris. The rigid support members 2*a*, 2*b* allow the user to readily control and pick up the lifting device by placing the first support member 2*a* in one hand approximately centered on the support or handhold (FIG. 6), and the second support member 2*b* in a second hand approximately centered on the second support (FIGS. 11 and 12). With the support members 2*a* and 2*b* in hand, the user can readily maneuver the lifting device 10 by grabbing hold of each of the support members 2*a*, 2*b* (FIG. 11) and then moving the support members toward each other and under the debris (FIG. 12). The user is then able to easily and conveniently lift the device filled with the loose, solid material "D", transport it, and discharge it into a suitable receptacle 14 (e.g., standard paper yard bag or other rigid or non-rigid refuse container) as illustrated in FIGS. 8 and 13-15.

The size of the lifting device 10 of the present embodiment is designed to the particular ergonomic agility of an adult human being, and also relates to the circumference of the opening of a standard paper yard bag, so that the lifting device is readily maneuvered by the user while also easily fitting into the yard bag or other similarly sized receptacle. Therefore, the optimal width of the lifting device 10 is approximately in the range of about 30" to about 48" as measured between the two parallel support members. The length of the lifting device 10 is approximately in the range of about 36" to about 52" in order to be a manageable size easily maneuvered by an adult human being with normal agility.

Figure 19:
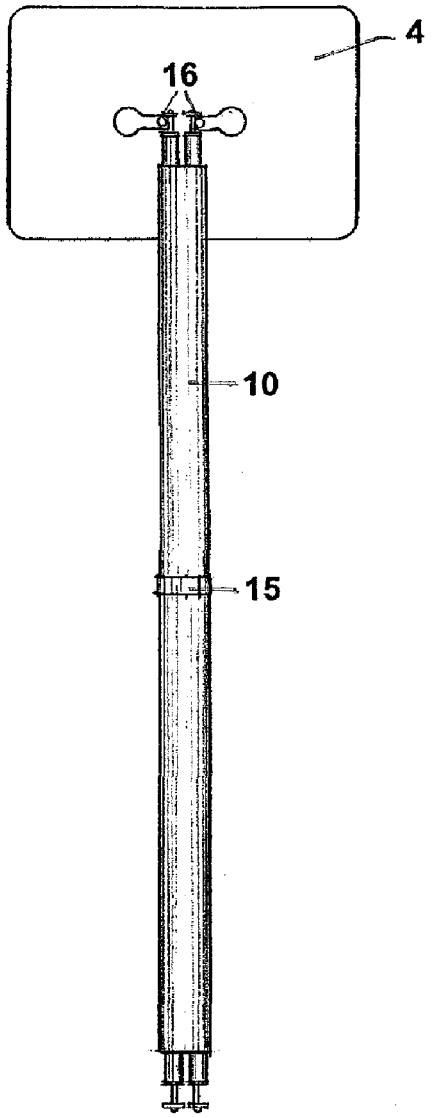
FIG. 19 is a front view of the lifting and compacting device of FIG. 3 in a vertical storage position on a hook mounted on a wall or other vertical support.
Figure 20:
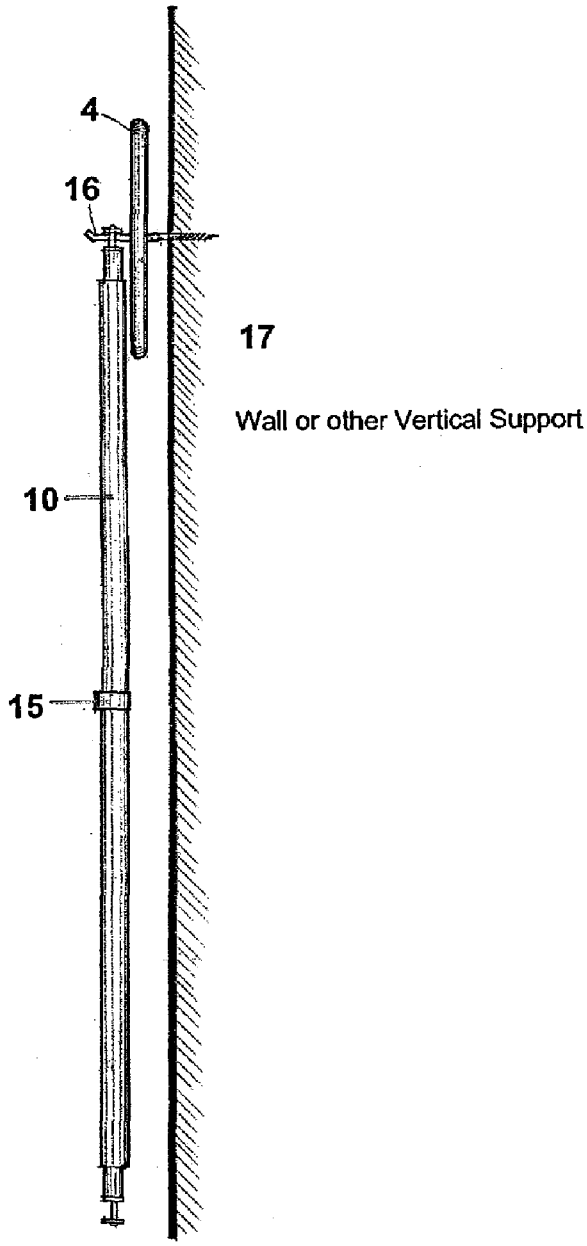
FIG. 20 is a side view of the lifting and compacting device of FIG. 3 in a vertical storage position on a hook mounted on a wall or other vertical support.

The support members 2*a*, 2*b* of the present embodiment additionally have mounting members 3 which are attached symmetrically at each end. The mounting members 3 are key shaped components in the present embodiment, as best illustrated in FIGS. 4.2 and 4.3. As illustrated in FIG. 8, one function of the mounting members 3 is to provide a hand-hold at the top of the support members 2*a*, 2*b*, when the device is full of loose solid material/garden debris and held in a vertical position over the refuse receptacle 14. Griping the mounting members 3 with one hand and releasing the other hand from the center position allows the tension at the bottom of the device to release, thus allowing the loose solid material/garden debris to discharge into the receptacle 14. The second function of the mounting members 3 is to engage the compaction device 4 (FIGS. 3, 4.1, 4.2 and 4.3) in order to secure the lifting device 10 to the compaction device 4 and form the two-in-one debris removal and compacting tool 12. The third function of the mounting members 3 is to engage a hook, for example a hook having a fork shape, attached to a wall or other vertical surface as shown in FIGS. 19 and 20 to conveniently hang and store the lifting device in a vertical position when not in use.

As described hereinabove, the lifting device 10 together with the compaction device 4 form debris removal and compacting tool 12, with the lifting device and compaction device being removably secured together. To use the lifting device 10 it is removed from engagement with the compaction device 4, while use of the compaction device 4 is achieved when the lifting device is secured as a handle to the compaction device. The compaction device can be used to compress the loose material/garden debris within the receptacle for better receptacle utilization, as described in greater detail below.

The debris removal and compacting tool 12 includes lifting device 10 secured to compaction device 4 (FIGS. 2.1, 2.2, and 2.3) which engages the loose material/garden debris "D" within the receptacle in order to compact the material. The compaction device 4 may be a substantially rigid plate including a first or top surface 4*a* for connection to the lifting device 10 and a second, or bottom surface 4*b* (opposite top surface 4*a*) to contact the loose material/garden debris within the receptacle 14 so as to compact the same. FIG. 2.1 illustrates the top view of the compaction device 4 including top surface 4*a* and at least two openings 5 cut through plate 4 that are configured and dimensioned to receive corresponding key shaped mounting members 3 there through. As best shown in FIG. 2.2 the bottom surface 4*b* of the compaction device 4 includes at least two keyhole openings 5 cut through the plate, and two spacers 6 attached to the bottom surface 4*b*. As best shown in FIG. 2.3, the spacers 6 may be attached to the bottom of a compaction device 4 in order to hold the device 4 above a resting surface when the bottom surface 4*b* is opposite the resting surface. The compaction device may be preferably sized to the throat circumference of a standard paper yard bag and is considered so that the compacting device easily fits into the opening and throat of the receptacle 14. In the present embodiment, the size of the compacting device is approximately 11½"×15½" in order to meet this criteria, but could be another shape or size to fit other sized receptacles more effectively, as would be known to those of skill in the art.

Connection of the lifting device handle 16 and the compaction device 4 is accomplished by a fastening mechanism 18 that positions the handle axis in a substantially perpendicular orientation and centered relative to the surface 4*a* defined by the compaction device 4. As illustrated in FIGS. 4.1, 4.2 and 4.3, the fastening mechanism 18 includes the symmetrical key shaped mounting members 3 supported at the ends of the lifting device support members 2*a*, 2*b*, and keyhole openings 5 disposed in the compaction device 4 (FIG. 4.1). The key shaped mounting members 3 are first inserted into a corresponding keyhole opening 5*a* (FIG. 4.1 and FIG. 4.2) and then slid into a corresponding keyhole slot 5*b* (FIG. 4.2) to secure the compaction device 4 to the handle 16. The mounting members 3 may include two thin flanges 3*a*, that have approximately the same profile as the support member end, separated by a tubular shaft 3*b* smaller in width than the flanges and of a height slightly larger than the thickness of the compaction device 4 in order for the key shaped mounting members 3 to slide freely into the key hole slot 5 (FIG. 4.3). The two-in-one lifting and compacting device 12 may be conveniently stored when not in use by securing the fabric of the lifting device with a strap 15 and sliding the keyhole openings 5 over a fork shaped hook 19 (FIGS. 19, 20) supported on vertical surface or wall 17, thus completing the storage of the lifting and compacting device. Alternatively, other manners of attaching the lifting and compacting devices may be utilized, as would be know to those of skill in the art.

Figure 9:
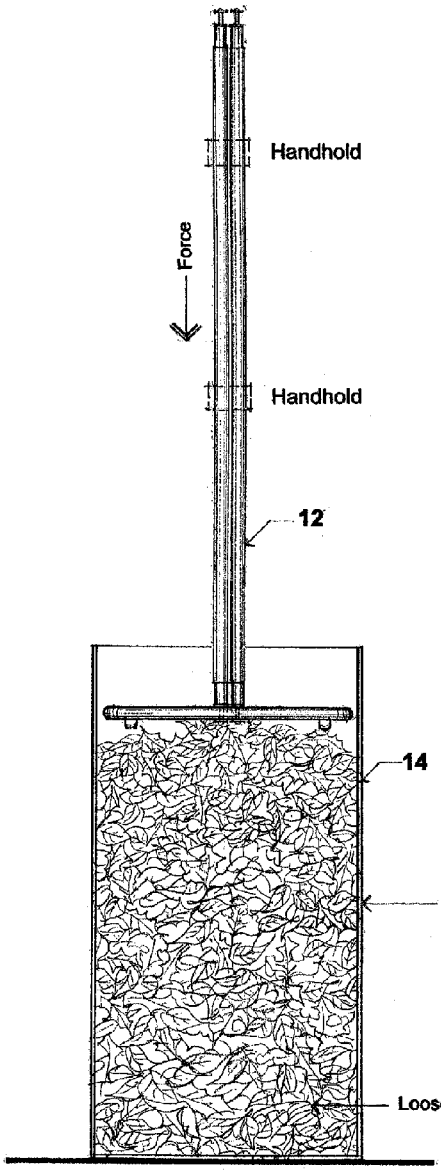
FIG. 9 is a side view of the debris removal and compacting tool of FIG. 3 with the compaction plate in position over non-compacted loose, solid material in a first non-compacting position within the receptacle.
Figure 10:
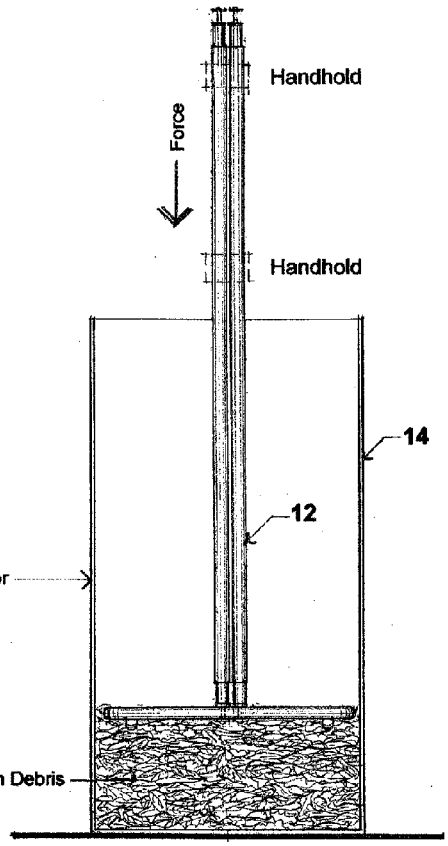
FIG. 10 is a side view of the debris removal and compacting tool of FIG. 3 with the compaction plate in position after a downward force is exerted on the device to compress the loose, solid material within the receptacle.

Referring now to FIG. 3, formation of the debris removal and compacting tool 12 by connection of the lifting device 10 of FIG. 1, including flexible sheet 1, support members 2*a*, 2*b*, and mounting members 3 to the compaction device 4 of FIGS. 2.1, 2.2 and 2.3, is illustrated. The lifting device 10 and compaction device 4 together form the debris removal and compacting tool 12 including the handle 16 having the longitudinal handle axis, and plate 4 configured to contact loose solid material/garden debris within a standard refuse receptacle 14 (FIG. 9). The length of the lifting device handles is greater than the height of a standard paper yard bag to enable a user to compact the loose material/garden debris within the yard bag while the user is in a standing position. Accordingly, the user is able to conveniently apply a downward force to effectively compress the loose solid material/garden debris within the receptacle (FIG. 10). In the present embodiment the overall length of the lifting device support member is at least approximately 4'–0", although other sizes may readily be used according to the height of the receptacle, as would be known to those of skill in the art.

The lifting device 10 and it's transformation to the compacting device 12 overcomes the ineffectiveness of other products on the market, and provides a cost-effective, simple device that can be utilized by a single user to collect and deposit loose, solid material and garden debris within any of a variety of conventionally available debris containers.

While embodiments of the invention have been particularly shown and described, it will be understood by those skilled in the art that various changes in form and details may be made therein without departing from the spirit and scope of the invention as defined by these claims. For example, the dimensions, geometric shapes, and materials disclosed herein may be varied, including but not limited to the shape of the key members, as would be known to those of skill in the art. Furthermore, it should be understood that the drawings are not necessarily to scale, emphasis instead being placed upon illustrating the principles of various embodiments of the invention.

What is claimed is:

1. A debris removal and compacting tool for consolidating, lifting and compacting loose material within a receptacle, the tool comprising:

a lifting device including a flexible sheet having a first edge and a second edge, the first edge being secured to a first support member and the second edge being secured to a second support member, the flexible sheet being disposed there between;

a compaction device including a first, top surface constructed and arranged to attach to the lifting device, and a second, bottom surface opposite the top surface and constructed and arranged to contact the loose material within the receptacle;

a fastening mechanism constructed and arranged to removably secure the lifting device to the compaction device, wherein the first support member and the second support member of the lifting device together form a handle when the lifting device is secured to the compaction device; and wherein, during use, a user engages the first and second support members to place the flexible sheet into contact with the loose material, and utilizes the first and second support members to move the flexible sheet in order to consolidate and maneuver the loose material onto the flexible sheet, the user thereafter lifting the lifting device, placing it within the interior of the receptacle, releasing the loose material from within the lifting device into the receptacle, attaching the first and second support members to the compaction device, placing the compaction device into contact with the loose material and applying a force in order to compact the material within the receptacle to achieve better receptacle utilization.

2. The debris removal and compacting tool of claim 1, wherein the fastening mechanism includes mounting members supported at the ends of the lifting device handle, and corresponding openings disposed in the compaction device.

3. The debris removal and compacting tool of claim 2, wherein the openings disposed in the compaction device have a key shape and the mounting members have a complimentary key shape constructed and arranged to be inserted within the openings of the compaction device in order to secure the compaction device to the lifting device.

4. The debris removal and compacting tool of claim 3, wherein the mounting members further include at least two flanges, and a tubular shaft that is smaller in width than the flanges and which extend there from, the height of each tubular shaft being slightly larger than the thickness of the compaction device in order that the key-shaped mounting members slide freely into the corresponding key shaped holes to secure the compaction device to the lifting device.

5. The debris removal and compacting tool of claim 1, further comprising spacers supported on the bottom surface of the compaction device and constructed and arranged to hold the compaction device above a resting surface when the bottom surface is opposite the resting surface.

6. The debris removal and compacting tool of claim 1, wherein the compaction device is a plate.

7. The debris removal and compacting tool of claim 1, wherein the width of the lifting device is in the range of about 30" to about 48" as measured between first and second support members.

8. The debris removal and compacting tool of claim 1, wherein the length of the lifting device is in the range of about 36" to about 52".

9. A debris removal and compacting tool for consolidating, lifting and compacting loose material within a receptacle, the tool comprising:

a lifting device including a flexible sheet having a first edge and a second edge, the first edge being secured to a first support member and the second edge being secured to a second support member, the flexible sheet being disposed there between;

a compaction device including a first, top surface constructed and arranged to attach to the lifting device, and a second, bottom surface opposite the top surface and constructed and arranged to contact the loose material within the receptacle;

a fastening mechanism including a mounting member supported on at least one end of at least the first support member and the second support member, and corresponding openings disposed in the compaction device and which are configured and dimensioned to removably secure the first and second support members to the compaction device wherein the first and second support members form a handle when secured to the compaction device; and wherein, during use, a user engages the first and second support members to place the flexible sheet into contact with the loose material, and utilizes the first and second support members to move the flexible sheet in order to consolidate and maneuver the loose material onto the flexible sheet, the user thereafter lifting the lifting device, placing it within the interior of the receptacle, releasing the loose material from within the lifting device into the receptacle, attaching the first and second support members to the compaction device, placing the compaction device into contact with the loose material and applying a force in order to compact the material within the receptacle to achieve better receptacle utilization.

10. The debris removal and compacting tool of claim 9, wherein the openings disposed in the compaction device have a key shape and the mounting members have a complimentary key shape constructed and arranged to be inserted within the openings of the compaction device in order to secure the compaction device to the lifting device.

11. The debris removal and compacting tool of claim 10, wherein the mounting members further include at least two flanges, and a tubular shaft that is smaller in width than the flanges and which extend there from, the height of each tubular shaft being slightly larger than the thickness of the compaction device in order that the key-shaped mounting members slide freely into the corresponding key shaped holes to secure the compaction device to the lifting device.

12. The debris removal and compacting tool of claim 9, further comprising spacers supported on the bottom surface of the compaction device and constructed and arranged to hold the compaction device above a resting surface when the bottom surface is opposite the resting surface.

13. The debris removal and compacting tool of claim 9, wherein the compaction device is a plate.

14. A method of consolidating, lifting and compacting loose material within a receptacle, comprising the steps of:

placing a lifting device including a flexible sheet having a first edge and a second edge, the first edge being secured to a first support member and the second edge being secured to a the second support member, in contact with the loose material;

maneuvering the lifting device so that the flexible sheet forms a cylindrical shape containing at least a portion of the loose material;

grabbing hold of each support member and moving the support members in a direction toward each other and around the loose material;

lifting the support members and the loose material contained within the flexible sheet;

transporting the lifting device and loose material contained therein into a receptacle;

discharging the material contained within the lifting device by moving the support members in a direction away from each other in order to release the loose material;

attaching the first and second support members to a compaction device so as to form a handle for maneuvering the compaction device;

engaging the compaction device with the loose material within the receptacle and applying a force in order to compact the loose material within the receptacle.

15. The method of claim 14, wherein attaching the first and second support members to the compaction device includes the step of inserting mounting members supported at the ends of the lifting device handle into corresponding openings disposed in the compaction device.

16. The method of claim 15, wherein the mounting members are key shaped and the openings have a corresponding keyhole shape and further include a corresponding keyhole slot to secure the handle to the compaction device.

17. The debris removal and compacting tool of claim 2, wherein the openings disposed in the compaction device are further configured and dimensioned to engage a mounting member supported on a vertical surface to store the tool when not in use.

18. The debris removal and compacting tool of claim 9, wherein the openings disposed in the compaction device are further configured and dimensioned to engage a mounting member supported on a vertical surface to store the tool when not in use.

19. The method of claim 15, further comprising the step of storing the attached lifting device and compaction device by securing the flexible sheet of the lifting device with a strap and inserting the openings disposed in the compaction device into a mounting member supported on a vertical surface.

* * * * *